US007267356B2

(12) United States Patent
Buquet et al.

(10) Patent No.: US 7,267,356 B2
(45) Date of Patent: Sep. 11, 2007

(54) SIMPLIFIED SAFETY-BINDING HEELPIECE FOR A SKI BOOT

(75) Inventors: Thierry Buquet, Coulanges les Nevers (FR); Frédéric Farges, Nevers (FR)

(73) Assignee: Look Fixations S.A., Nevers (FR)

( * ) Notice: Subject to any disclaimer, the term of this patent is extended or adjusted under 35 U.S.C. 154(b) by 136 days.

(21) Appl. No.: 10/989,712

(22) Filed: Nov. 16, 2004

(65) Prior Publication Data

US 2005/0110241 A1 May 26, 2005

(30) Foreign Application Priority Data

Nov. 20, 2003 (FR) ..... 03 13602

(51) Int. Cl.
*A63C 9/00* (2006.01)

(52) U.S. Cl. ..... 280/616; 280/624

(58) Field of Classification Search ..... 280/616, 280/617, 623, 624, 633, 11.31, 618, 614
See application file for complete search history.

(56) References Cited

U.S. PATENT DOCUMENTS 3,249,365 A 5/1966 Beyl
4,176,857 A * 12/1979 Bodendorfer ..... 280/613
4,674,766 A * 6/1987 Ramer ..... 280/614
4,679,815 A * 7/1987 Pascal et al. ..... 280/618
4,863,186 A 9/1989 Rullier et al.
4,893,831 A * 1/1990 Pascal et al. ..... 280/618
5,741,023 A * 4/1998 Schiele et al. ..... 280/607
6,206,404 B1 * 3/2001 Buquet et al. ..... 280/624
6,244,617 B1 * 6/2001 Chonier et al. ..... 280/605
6,296,267 B1 * 10/2001 Buquet ..... 280/626

FOREIGN PATENT DOCUMENTS

EP 0 893 146 A 1/1999
FR 2 765 115 A 12/1998

* cited by examiner

*Primary Examiner*—Christopher Bottorff
(74) *Attorney, Agent, or Firm*—Frommer Lawrence & Haug LLP; Ronald R. Santucci

(57) ABSTRACT

A safety-binding heelpiece, for a ski boot, comprising a tubular body (1) having a trigger function and including, at one of its ends, a heel grip (2) for holding the heel of a ski boot on a ski, this tubular body (1) being articulated in rotation about a cam (3) formed in a cylindrical piece, this cam being integral with two lateral arms (4) connected to a base (8) mounted so as to move longitudinally on a plinth (9) for fasting to a ski, the separation between the two arms (4) at the base being smaller than their separation at their link with the cam.

12 Claims, 4 Drawing Sheets

(PRIOR ART)

SIMPLIFIED SAFETY-BINDING HEELPIECE FOR A SKI BOOT

This application claims priority benefits from French Patent Application No. 03 13602 filed Nov. 20, 2003.

BACKGROUND OF THE INVENTION

The invention relates to a safety-binding heelpiece for a ski boot, i.e. a device for securely holding the rear of a boot on a ski by exerting a pressure on the boot heel while pressing the entire boot forward against a front binding device, and guaranteeing automatic release of the rear of the boot in the event of the skier falling forward. It also relates to a ski to which a heelpiece of this type is fixed.

DESCRIPTION OF THE PRIOR ART

A heelpiece—which has become one of the applicant's brand images—is, for example, described in patents FR2765115 and EP0893146. A heelpiece of this type is shown diagrammatically in FIG. 1. It is composed of a tubular cylindrical body 1 comprising, at one end, a heel grip 2. This body is articulated in rotation about a cam 3 formed in a cylindrical piece forming part of a U-shaped stirrup piece of which the two arms 4 are connected to a pivotably mounted plate 5. This plate 5 is generally mounted on a base that is itself mounted on a relatively wide slide fastened to the ski 6 so that it is possible to adjust the longitudinal position of the binding. The body 1 has a trigger function, making it possible to release the rear of the boot in the event of significant force, as is the case when a skier falls forward. To that end, this body 1 generally comprises a helical spring working in compression between a piston bearing on the cam 3 and a stop located toward the end opposite the cam. The form of the cam 3 is such that, through the effect of the spring's pressure, the boot 7, once placed in the binding, is pressed forward against the front binding and downward against the ski. Only a significant force will allow the body 1 to rock about the cam 3, pushing back the piston and compressing the spring, which triggers opening of the heelpiece. The advantage of this heelpiece of the applicant lies in the fact that the trigger function is in the tubular body 1, and therefore physically distinct from the other principal functions of the heelpiece, namely the function of adjusting its longitudinal position on the ski. This facilitates maintenance and repair of these heelpieces as compared to conventional heelpieces in which all the functions, including the trigger function, are combined in one and the same body positioned directly on the ski. Furthermore, this type of triggering makes it possible to release the binding when very high forces are present, particularly suited to competition skiing, unlike the above-mentioned conventional mechanisms.

However, the applicant's heelpieces described above have the following drawbacks on account of their complexity:

- the arms 4 of the stirrup piece have overall a significant separation, as they follow the lateral contours of the ski boot 7 between their link to the plate 5 and their link to the cam 3. This geometry gives rise to a risk that the lateral parts of the binding will catch on the snow, principally when the ski is being turned, and will unexpectantly modify the ski's trajectory;
- the trigger mechanism overhangs the points where the arms are secured to the pivoting plate and the base, which requires thick, rigid arms to withstand the significant forces exerted upon them. These arms contribute to an increase in the weight of the heelpiece as a whole;
- these heelpieces comprise a plurality of pieces placed in front of the heel grip, which represents an overall bulk that is difficult to manage in order to allow positioning of the ski boot whose shape and dimensions are standardized and cannot be modified;
- they are expensive.

Those skilled in the art took account of numerous safety aspects when developing these bindings and proposed a complex solution composed of numerous mechanical functions, making it possible in effect to deal with certain safety problems efficiently, but at the same time adding the new drawbacks that are listed above.

SUMMARY OF THE INVENTION

An object of the present invention is to propose a simplified safety-binding heelpiece for a ski boot that retains the above-mentioned advantages of the applicant's solution but does not have the drawbacks thereof.

More precisely, a first object of the invention consists in proposing a heelpiece in which the trigger function is physically distinct from the other functions.

A second object of the invention consists in proposing a heelpiece with a small lateral dimension, in order to eliminate the risk of catching on the snow.

A third object of the invention consists in proposing a heelpiece that maximizes the space freed up in front of the heel grip with a view to optimizing the positioning of the boot.

A fourth object of the invention consists in proposing a simple heelpiece that is light in weight and inexpensive.

The invention achieves the above-mentioned objects by proposing a safety-binding heelpiece, for a ski boot, comprising a tubular body having a trigger function and including, at one of its ends, a heel grip for holding the heel of a ski boot on a ski, this tubular body being articulated in rotation about a cam formed in a cylindrical piece, this cam being integral with two lateral arms connected to a base mounted so as to move longitudinally on a plinth for fastening to a ski, the separation between the two arms at the base being smaller than their separation at their link with the cam.

The arms may have a V shape in a projection in a transverse plane and their separation at their link with the base may be substantially half the maximum separation between the arms at their link with the cam.

Elsewhere, the arms may have a rearward tilt, it being possible for this rearward tilt of the arms to be of the order to 60 degrees relative to the plane of the plinth.

The arms may be made from metal and connected to the base by a link riveted by at least two securing pins traversing the base transversely or with the aid of at least two through-screws. The axis of the cam and the first securing pin are substantially in the same vertical plane.

As a variant embodiment, the arms and the base form a single piece made from synthetic material, and a metal insert at least partially surrounds the cam so as to strengthen the heelpiece.

The forward length of the part of the plinth that projects beyond the heel grip is short, and the height of the cam over the plinth is reduced to a height substantially close to the height of the heel of a ski boot.

The invention also relates to a ski equipped with such a safety-binding heelpiece for a ski boot.

DESCRIPTION OF THE DRAWINGS

By way of example, one embodiment is described below with reference to the appended drawing, in which.

DESCRIPTION OF THE PREFERRED EMBODIMENT

Figure 1:
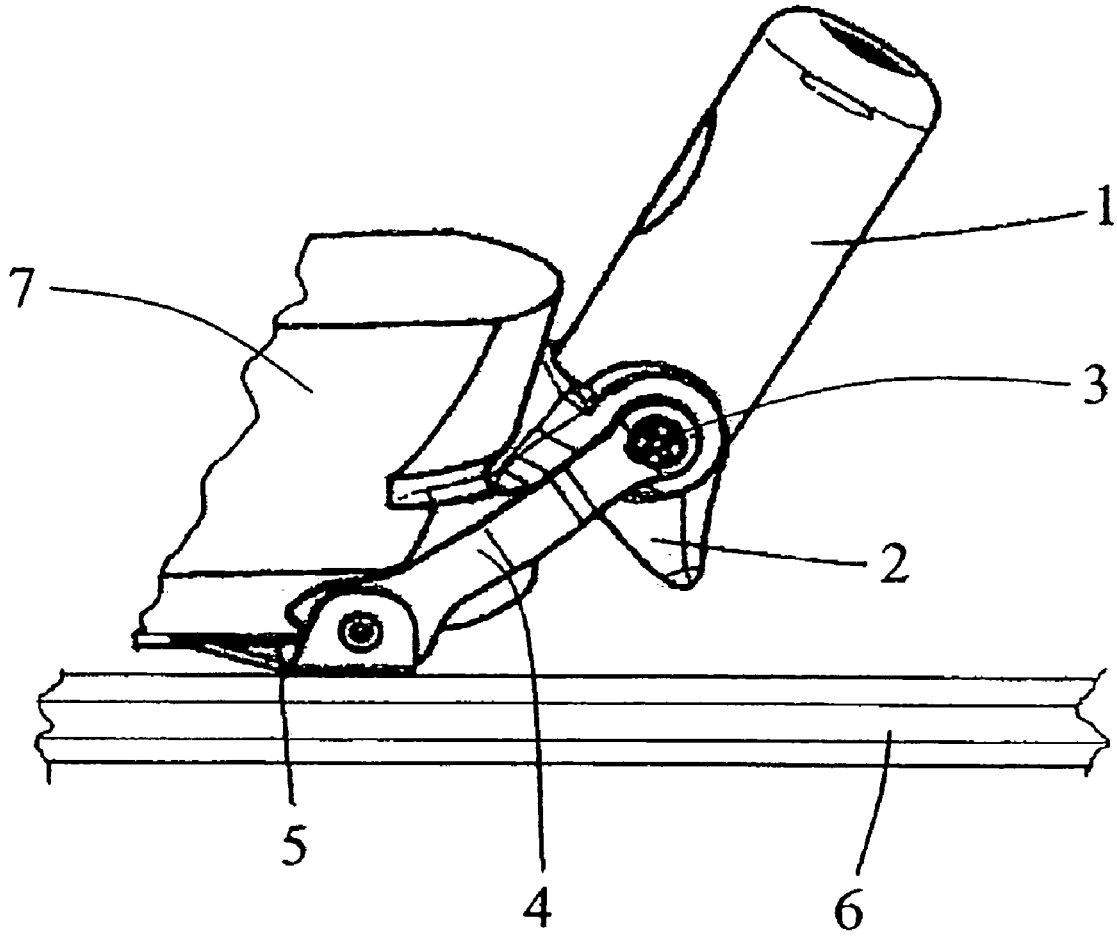
FIG. 1 shows a heelpiece of the Applicant according to the prior art.
Figure 2:
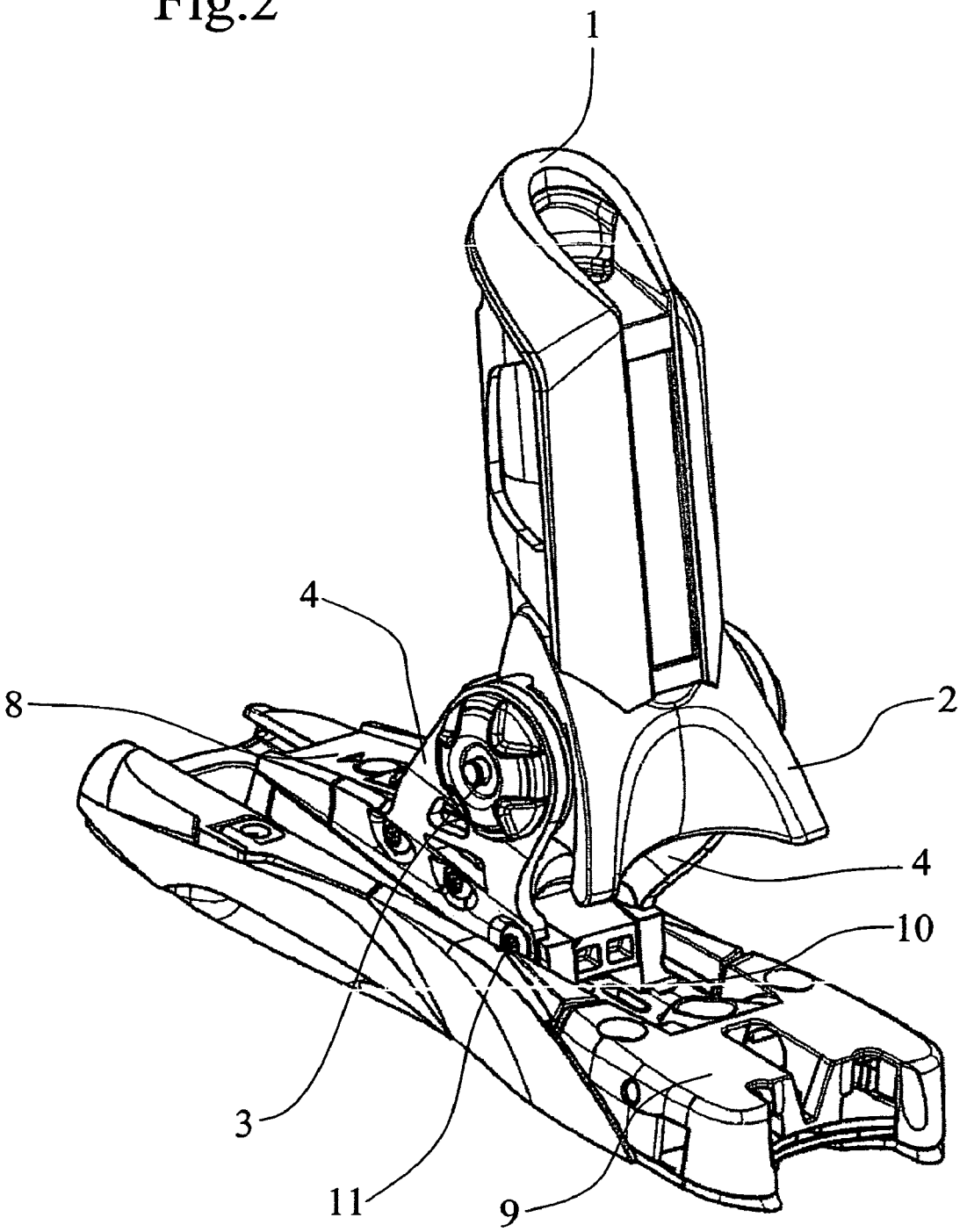
FIG. 2 shows a perspective view of a heelpiece according to one embodiment, in the closed position.
Figure 3:
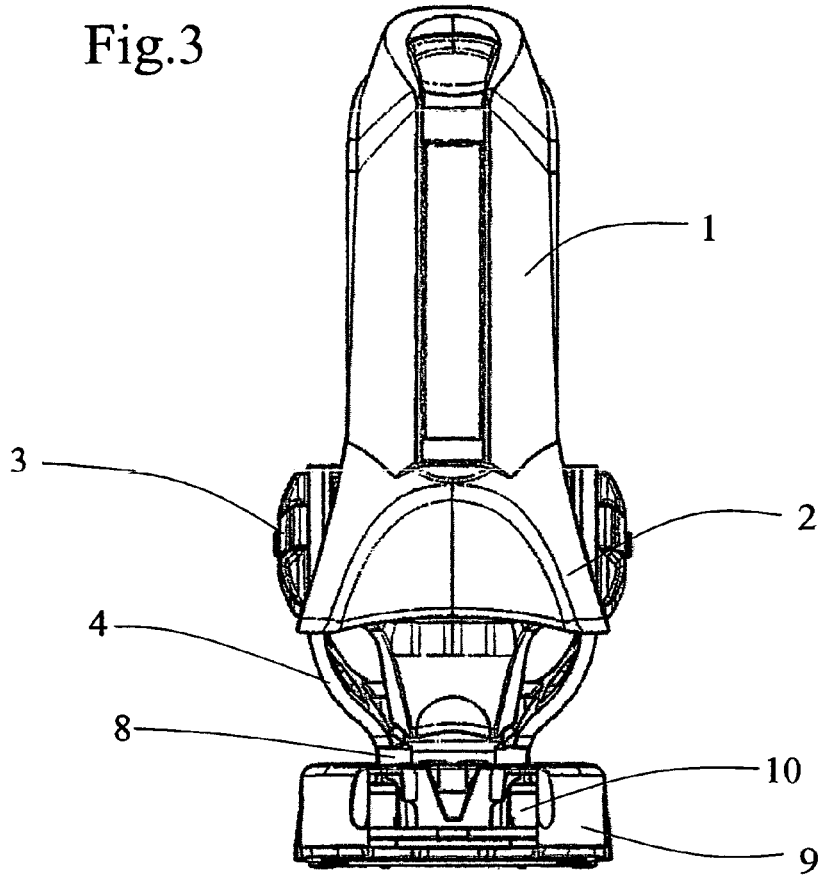
FIG. 3 shows a front view of a heelpiece according to one embodiment, in the closed position.
Figure 4:
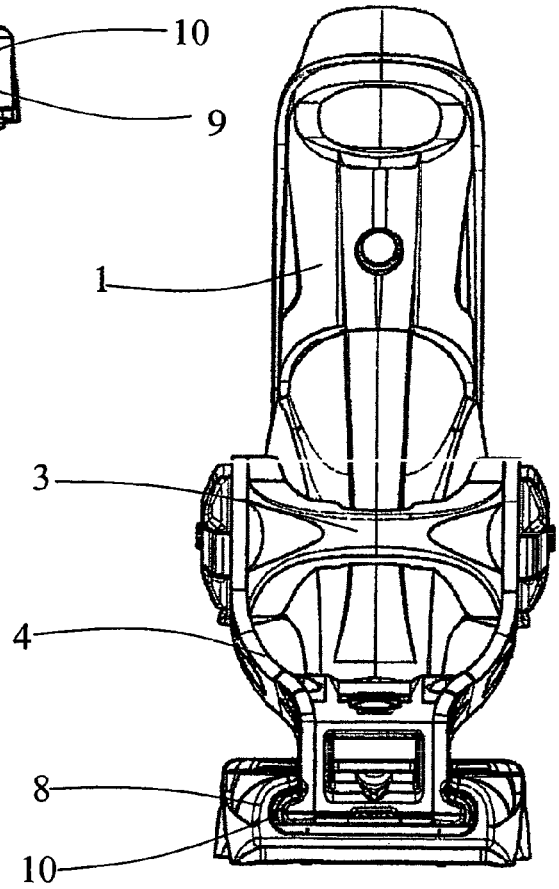
FIG. 4 shows a rear view of a heelpiece according to one embodiment, in the closed position.
Figure 5:
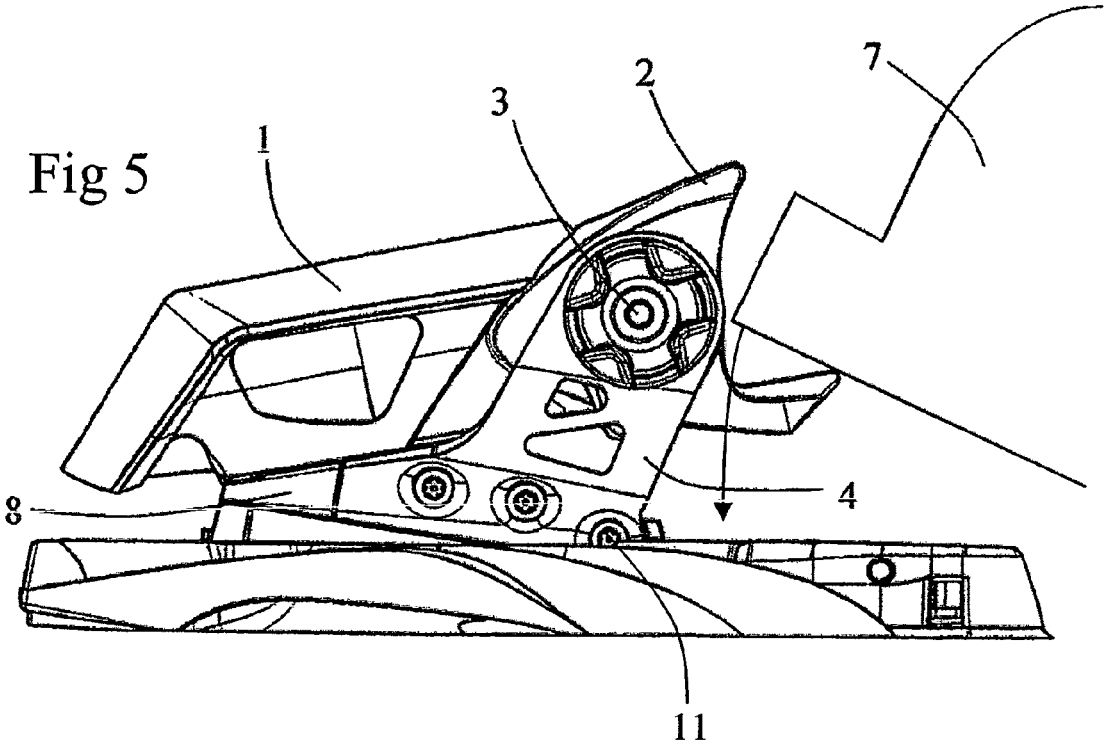
FIG. 5 shows a side view of a heelpiece according to one embodiment, in the open position.

In the various figures, the same reference numerals will be used for corresponding elements.

With reference to FIGS. 2 through 6, the heelpiece according to one embodiment comprises a tubular body 1 similar to that of the prior art described with reference to FIG. 1. This body 1 is articulated about a cam 3, formed in a cylindrical piece, with a view to positioning the heel grip 2 over the heel of a ski boot 7 in the closed position. Two arms 4 are fastened, on the one hand, to the lateral edges of the cam 3 and, on the other hand, to a base 8 that is itself mounted on a plinth 9 so as to be movable in a longitudinal direction with the aid of a slide link 10. The base 8 is held and moved longitudinally on the plinth 9 by known prior-art means (not shown). The plinth 9 is designed for fastening onto a ski.

The heelpiece provides a trigger function, contained in the body 1, that is totally distinct from the function of longitudinal adjustment of the binding, achieved by means of the link between the base 8 and the plinth 9. Moreover, it makes use of the triggering technology adapted to competition skiing.

The space in front of the heel grip 2 is entirely empty. Only the plinth remains. The thickness of the front of the binding and the length of the plinth are thus reduced. This allows a positioning of the boot sole at the lowest point, there being no interference since the overall bulk is reduced, positioning being easier even when snow has collected under the boot, for example. Furthermore, the height of the arms is reduced to a height substantially equal to that of the boot heel.

At their base, the arms 4, at their link with the base 8, are separated by a shorter distance than their separation at their link with the cam, this being up to substantially half this maximum separation. Thus, these arms no longer present the drawbacks of risking rubbing on the snow. As may be seen in FIGS. 3 and 4, they have a substantially V shape in a projection in a transverse plane and their separation at their link with the base is smaller than their separation at their link with the cam, unlike the customary U shapes. Moreover, this form has the further advantage that it allows the use of narrow slides, which promotes all the more the overall reduction in the lateral bulk of the heelpiece.

The arms 4 are made from metal and fastened to the base 8 by a link riveted by means of three securing pins traversing the base 8 transversely. In a variant embodiment, the arms 4 may be fastened to the base 8 with the aid of three through-screws. They are, moreover, tilted rearward. In fact, their base is significantly set back relative to their upper part: the rearward slope is of the order of 60 degrees relative to the plinth in this embodiment (see FIG. 6). This geometry allows the cam 3 and the first securing pin 11 to be practically in line in the same vertical plane, which significantly reduces the overhang of the trigger mechanism relative to the linking points of the arms 4 with the base 8. As these arms have less force exerted on them than in the prior art, they are lighter in weight.

According to an even more inexpensive variant embodiment, the arms 4 form a single piece with the base 8 and the whole is made from synthetic material. The articulation of the body 1 about the articulation axis of the cam 3 is strengthened with the aid of a metal part inserted at least partially around the cam 3.

Figure 6:
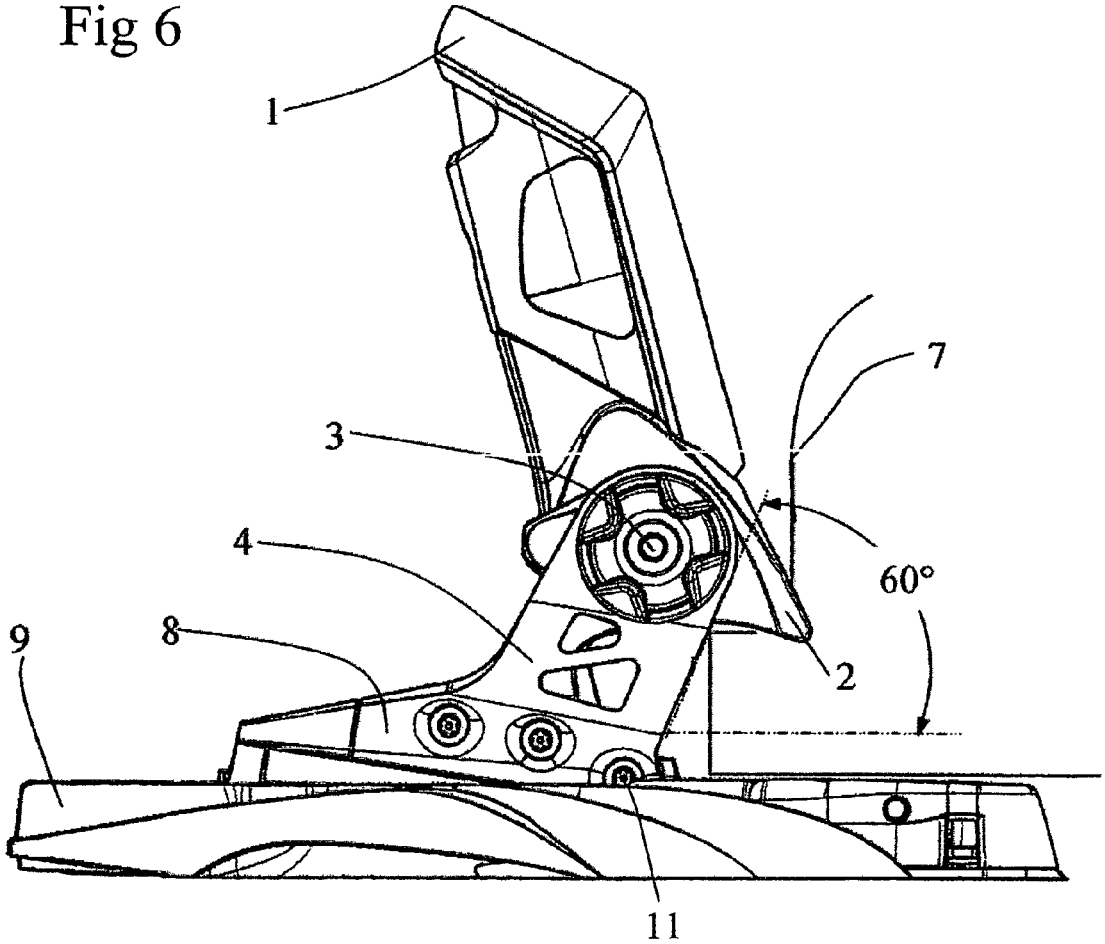
FIG. 6 shows a side view of a heelpiece according to one embodiment, in the closed position.

The heelpiece according to the embodiment also greatly facilitates the placing of a ski boot in the binding, which may be achieved directly by pressing the heel down on the heel grip 2 in the open position, using a technique widely known as the "step-in technique". To that end, the heel is firstly positioned on the heel grip 2 of the heelpiece in the open position, in the manner shown in FIG. 5. Pressure on the heel will allow the boot to be placed in the binding so as to arrive at the closed position of the heelpiece, as shown in FIG. 6. During this phase of placing the boot in the binding, the heel describes an arc of a circle, shown in FIG. 5, therefore remaining close to the arms 4 throughout the entire time it is being placed in the binding.

The heelpiece thus described therefore retains the advantages of the prior art without presenting the drawbacks thereof.

The invention claimed is:

1. A safety-binding heelpiece, for a ski boot, comprising a tubular body (1) having a trigger function and including, at one of its ends, a heel grip (2) for holding the heel of a ski boot on a ski, said tubular body (1) being articulated in rotation about a cam (3) formed in a cylindrical piece, said cam being integral with two lateral arms (4) connected to a base (8) mounted so as to move longitudinally on a plinth (9) for fastening to a ski, wherein the separation between the two arms (4) at the base is smaller than their separation at their link with the cam, and wherein the two arms do not risk rubbing against snow.

2. The safety-binding heelpiece for a ski boot as claimed in claim 1, wherein the arms (4) have a substantially V shape in a projection in a transverse plane.

3. The safety-binding heelpiece for a ski boot as claimed in claim 2, wherein the separation between the arms (4) at their link with the base is substantially half the maximum separation between the arms (4) at their link with the cam (3).

4. The safety-binding heelpiece for a ski boot as claimed in claim 1, wherein the arms (4) have a rearward tilt.

5. The safety-binding heelpiece for a ski boot as claimed in claim 4, wherein the rearward tilt of the arms (4) is of the order of 60 degrees relative to the plane of the plinth (9).

6. The safety-binding heelpiece for a ski boot as claimed in claim 1, wherein the arms (4) are metal and connected to the base (8) by a link riveted by at least two securing pins traversing the base (8) transversely or with the aid of at least two through-screws.

7. The safety-binding heelpiece for a ski boot as claimed in claim 6, wherein the axis of the cam (3) and the first securing pin (11) are substantially in the same vertical plane.

8. The safety-binding heelpiece for a ski boot as claimed in claim 1, wherein the arms (4) and the base (8) form a single piece made from synthetic material.

9. The safety-binding heelpiece for a ski boot as claimed in claim 8, wherein a metal insert at least partially surrounds the cam (3) so as to strengthen the heelpiece.

10. The safety-binding heelpiece for a ski boot as claimed in claim 1, wherein the forward length of the part of the plinth (9) that extends beyond the heel grip is short.

11. The safety-binding heelpiece for a ski boot as claimed in claim 1, wherein the height of the cam (3) over the plinth (9) is reduced to a height substantially close to the height of the heel of a ski boot.

12. A ski equipped with a safety-binding heelpiece for a ski boot as claimed in claim 1.

* * * * *